United States Patent [19]

Chambers et al.

[11] Patent Number: 5,002,685

[45] Date of Patent: Mar. 26, 1991

[54] TRANSLUCENT DETERGENT BAR HAVING A REDUCED SOAP CONTENT

[75] Inventors: John G. Chambers; Terry Instone, both of Wirral, United Kingdom

[73] Assignee: Lever Brothers Company, Division of CONOPCO, Inc., New York, N.Y.

[21] Appl. No.: 373,764

[22] Filed: Jun. 29, 1989

[30] Foreign Application Priority Data

Jul. 7, 1988 [GB] United Kingdom ..... 8816201

[51] Int. Cl.[5] ..... C11D 9/02; C11D 13/16; C11D 17/00

[52] U.S. Cl. ..... 252/134; 252/90; 252/92; 252/93; 252/174; 252/367; 252/368; 252/369; 252/370; 252/DIG. 16

[58] Field of Search ..... 252/DIG. 16, 134, 367, 252/368, 369, 370, 174, 92, 93, 122, DIG. 5

[56] References Cited

U.S. PATENT DOCUMENTS

| | | | |
|---|---|---|---|
| 3,149,188 | 9/1964 | Schmitt | 252/92 |
| 3,562,167 | 2/1971 | Kamen et al. | 252/174 |
| 3,903,008 | 9/1975 | Deweever et al. | 252/DIG. 5 |
| 4,273,684 | 6/1981 | Nagashima et al. | 252/DIG. 16 |
| 4,504,433 | 3/1985 | Inui et al. | 264/232 |
| 4,584,126 | 4/1986 | Joshi | 252/DIG. 16 |
| 4,606,389 | 8/1986 | Harding | 252/134 |
| 4,674,394 | 3/1987 | Kimura et al. | 252/117 |
| 4,879,063 | 11/1989 | Wood-Rethwill et al. | 252/DIG. 16 |

FOREIGN PATENT DOCUMENTS

| | | |
|---|---|---|
| 0062352 | 10/1982 | European Pat. Off. . |
| 0321179 | 6/1989 | European Pat. Off. . |
| 170781 | 11/1921 | United Kingdom . |
| 2121815 | 1/1984 | United Kingdom . |

OTHER PUBLICATIONS

Chemical Abstracts No. 86727J, vol. 106, No. 6, Mar. 1987 (Shideido Co., Ltd.).

Chemical Abstracts No. 125373a, vol. 103, No. 16, 1985.

The Chemical Formulary (vol. XI), Ed. H. Bennett, 1961, p. 340.

"Soap and Chemical Specialities", Transparent Gels, Henry Goldschmeidt, 4/1970, p. 48.

*Primary Examiner*—Paul Lieberman

*Assistant Examiner*—A. Beadles-Hay

*Attorney, Agent, or Firm*—Ronald A. Koatz

[57] ABSTRACT

A translucent detergent bar is provided containing with respect to the total weight of the bar 25 to 34 wt % soap, 5 to 15 wt % alcohol, 15 to 30 wt % sugar and/or cyclic polyol, and 15 to 30 wt % water, the soap comprising a soap mixture consisting of 18 to 26 wt % soluble soaps and 8 to 16 wt % insoluble soaps calculated with respect to the total weight of the bar. The bar has good user properties and yet can be a low cost bar due to its relatively low soap content.

10 Claims, No Drawings

TRANSLUCENT DETERGENT BAR HAVING A REDUCED SOAP CONTENT

The present invention relates to a detergent bar, particularly to a detergent soap-based bar having a translucent appearance.

Translucent and transparent soaps have for many years held an aesthetic appeal to consumers. Such bars can however be costly to produce, compared to conventional opaque soap bars, due to special processing techniques required to achieve the translucent or transparent effect. Transparent and translucent bars usually moreover have one or more properties inferior to those of opaque bars. In particular translucent and transparent bars can have a high rate of wear and an increased tendency to go mushy on contact with water. In order to produce a translucent or transparent bar of relatively good user properties it has been usual to ensure that its soap content is at least about 50 to 60 wt% of the final bar. The remaining ingredients usually comprise one or more components believed to be essential to render the bars translucent or transparent. Such ingredients have in the past included alcohol, glycerine and sugar and where transparency is particularly important rosin and castor oil. A review of transparent and translucent soaps having such a relatively high soap content is found at pages 465 to 472 of "Soap Manufacture" Vol. I by J Davidsohn, E J Better and A Davidsohn published by Interscience Publishers, Inc., New York 1953.

It is an object of the present invention to provide a translucent soap based detergent bar having acceptable user properties and a reduced soap content.

According to a first aspect of the present invention there is provided a translucent detergent bar containing with respect to the total weight of the bar 25 to 34 wt% soap, 5 to 15 wt% alcohol, 15 to 30 wt% sugar and/or cyclic polyol, and 15 to 30 wt% water, the soap comprising a mixture consisting of 18 to 26 wt% soluble soaps and 8 to 16 wt% insoluble soaps calculated with respect to the total weight of the bar.

Although translucent soap bars having a reduced soap content, and hence potentially a reduced manufacturing cost, have been proposed occasionally in the past the bars have invariably suffered from a number of the following disadvantages: poor user properties eg. high water uptake, poor mush, opaque mush, poor lather, high rate of wear; soft bars which are easily malleable; poor translucency; hygroscopic, sticky surface; and long preparative maturation times. Knowing that these many problems exist has meant that translucent bars having a reduced soap content have until the present invention been generally avoided as product concepts or when attempted been viewed as products having inferior user properties only. Examples of such products can be found in GB2121815 and EP 62352.

We have however now found that reduced soap content translucent bars having improved properties can be prepared provided that the above formulation ranges are followed. In particular we have found that it is possible to produce translucent soap bars having a reduced soap content yet having acceptable hardness and lather and rate of wear comparable to milled non superfatted soaps and not having a tendency to opacify due to water uptake. In addition the present bars can be highly translucent, they need not be sticky or hygroscopic and can moreover be made by a process that avoids long maturation times.

The possibility of producing the presently formulated bars by processing that avoids long maturation times, which can be of the order of 60 to 90 days, means that problems associated with bars produced by such maturation are also avoided. During traditional maturation solvent slowly evaporates from the soap bar and the initially opaque cast mixture changes to a translucent form. Solvent loss during maturation causes the bars to develop internal stresses and hence predisposes the bars to cracking in use. The presence or absence of such stress in a transparent bar, and hence its manufacturing route, can be detected by viewing the bar between crossed polarising filters. Non-matured bars, which do not contain stress patterns, will not pass a significant amount of light and will present a uniform dark appearance. Matured bars will however pass some light in their stressed areas and will thus present patterns of light and dark related to the stress distribution in the bar. Additionally, bars made by a maturation method have a crystal structure which tends to cause an opaque surface deposit to develop on the bars on prolonged contact with water. The composition of the present invention provides a means of providing translucent bars without these problems.

The present bars can moreover have a setting temperature of at least 40° C., preferably at least 45° C. The ability to prepare bars having such setting temperatures using the present formulations means that the resulting bars are compatible with hot water hand wash conditions and in addition can tolerate high ambient temperatures often encountered during storage prior to sale.

The soap content of the present composition comprises a mixture of soluble soaps and insoluble soaps. By "soluble" soaps we mean the monovalent salts of saturated fatty monocarboxylic acids having a carbon chain length of from 8 to 14 and additionally the monovalent salts of oleic acid and polyunsaturated fatty monocarboxylic acids having a carbon chain length of between 8 and 22. By "insoluble" soaps we mean monovalent salts of saturated fatty monocarboxylic acids having a carbon chain length of from 16 to 24. Preferably the soluble soap component comprises with respect to the total weight of the bar 16 to 20 wt% saturated soaps having a carbon chain length of from 8 to 14 and 2 to 6 wt% oleate and polyunsaturated soaps. Preferably the insoluble soap component comprises, with respect to the total weight of the final bar, 8 to 12 wt% palmitate and/or stearate soaps and 0 to 6 wt% of other saturated soaps having a chain length of 20 and 22 carbon atoms. Suitably the monovalent cation in the soaps is sodium. Low amounts of for example potassium and/or ammonium substituted with one or more alkyl or alkanol $C_1$ to $C_3$ groups can if desired be present.

The selection of soaps may depend on availability and cost of supply. Suitably however the present soluble soaps are derived from coconut oil, palm kernel oil and/or babassu oil, in addition to unsaturated soaps such as oleate or mixtures of oleate and linoleate. Appropriate sources of insoluble soaps include tallow, hydrogenated tallow, tallow stearine, hydrogenated soyabean oil, hydrogenated rice bran oil, hydrogenated fish oil, palm oil and palm stearine. Preferably a source or mixture of sources is employed which supplies an insoluble soap component containing soaps having at least two different chain lengths in order to ensure good translucency.

In order to provide the present bar with its translucency and a high degree of bar hardness it is essential that the finished bar contains alcohol, sugar and/or cyclic polyol and water in the ranges recited above. By "alcohol" we mean a $C_1$ to $C_3$ compound containing 1 or 2 alcohol groups. By "polyol" we mean a molecule containing 3 or more carbon atoms and 3 or more alcohol groups. Examples of alcohols include industrial methylated spirit, ethanol and propan-1,2-diol. Examples of cyclic polyols include sucrose, fructose and glucose. The water employed is preferably distilled or deionised. An additional and optional ingredient is glycerol or a linear or branched polyol compound having a carbon content of 4 or more and 2 or more alcohol groups, such as diethyleneglycol, triethyleneglycol, sorbitol, mannitol, or a polyethyleneglycol having molecular weight between 400 and 6000 , at a level with respect to the final bar of 0 to 20 wt%.

Additional ingredients such as antioxidants eg. butylhydroxy toluene, sodium sulphite and ethylenediaminetetraacetic acid; dyes; perfumes; and pearlescer can if desired be included. Optionally the bar could include a filler, such as kaolin, starch or carboxymethyl cellulose, or other inert material. The translucency of the bar would be lost, but its other properties would be retained. It is to be understood that the present invention extends to the present bar composition in combination with any additional material physically admixed therewith.

On standing the present bars may, like all soap bars, have a tendency to lose a small amount of water and/or alcohol present. It is to be understood that the present invention extends to such bars, provided that initially on preparation they had a formulation complying with that given above. If desired the newly prepared soap bars can be sealed in an air tight package According to a second aspect of the present invention there is provided a method of making a translucent bar comprising forming a melt at a temperature of between 70 and 85° C. of a mixture comprising 25 to 34 wt% soap, 5 to 15% alcohol, 15 to 30 wt% sugar and/or other cyclic polyol, and 15 to 30 wt% water, the soap comprising a soap mixture consisting of 18 to 26 wt% soluble soaps and 8 to 16 wt% insoluble soaps calculated with respect to the total weight of the bar, and cooling the melt to 30° C. or less.

Suitably the soap is added to and dissolved in the remaining ingredients which have already obtained a temperature of 70° to 85° C. We have found that such a method ensures the provision of an isotropic solution prior to cooling. If desired, minor ingredients such as antioxidants and perfume can be added to the melt prior to cooling.

Other than cooling to allow the melt to set the present method employing the presently recited formulation does not need any maturation time for the translucency to develop. In practice we have found that the present melt is itself translucent and cools and sets directly to a translucent solid form.

Preferably the melt is transferred to moulds prior to cooling. The moulds can if desired additionally serve as the eventual packaging material for example as described in our co-pending EP patent application 88311768.1 or once cooled and set the bars or slabs can be removed from the moulds, finished as necessary, and packed. EP88311768.1 describes a method of casting soap containing material in which a pack made at least substantially of a flexible film is filled and airtightly sealed with the material in a liquid or semi-liquid state, and the material is allowed to set to a substantially solid state and retained in the pack as an airtight storage means. Suitably the pack is transparent and is heat shrinkable and/or heat extensible so that it fits neatly around the end product. The solidified soap bar can thus have a skin-tight wrinkle free transparent pack immediately surrounding it giving it an attractive appearance. The contents of EP88311768.1 are hereby incorporated by reference.

The present invention thus provides a translucent soap bar which has good user properties and which additionally avoids the traditional problems associated with matured cast bars. The absence of maturation time permits the present soap composition to be cast in a liquid or semi-liquid state directly into a pack, which is ideally transparent and flexible. The resulting intimate contact between the bar surface and the pack film not only gives the end product excellent appearance and gloss, but also ensures that any surface roughness of the bar is minimised. As surface roughness causes light scattering on the bar surface which can be a major factor in reducing the apparent transparency of a cast bar, minimising the surface roughness enhances the transparent appearance of the resulting bar.

Throughout the present specification we mean by the word 'translucent' a soap bar or composition such that bold face type of 14 point size can be readily read through a ¼ inch section of material. For further details of this test see U.S. Pat. No. 3,274,119

Embodiments of the present invention will now be described with reference to the following Examples which are included by way of example only.

EXAMPLES 1 to 3

For each example the following procedure was employed. Each of the ingredients other than the soaps was mixed and heated to 70° to 85° C. The soap components were then added and dissolved to provide an isotropic solution. The solution was then poured into individual moulds and cooled to a temperature below 18° C. in order to allow it to set. The resulting bars in each case were translucent and had good user properties in terms of rate of wear, mush, lather and water absorption.

The formulation used in each example in terms of wt% of final bar is given in Table I below.

TABLE I

| Example | 1 | 2 | 3 |
|---|---|---|---|
| Palm stearine* | 13 | — | — |
| Coconut oil* | 17 | — | — |
| Hardened fish oil* | — | 12 | — |
| Babassu oil* | — | 18 | — |
| Tallow stearine* | — | — | 10 |
| Palm kernel oil* | — | — | 20 |
| Sucrose | 25 | 25 | 25 |
| Sorbitol | 10 | 10 | 10 |
| Industrial methylated spirit | 10 | 10 | 5 |
| Propan-1,2-diol | — | — | 5 |
| Water | 25 | 25 | 25 |

*The levels of oils given are the levels of soaps made from the stated oils.

EXAMPLES 4 to 9

A series of bars was prepared in which the ratio of alcohol to the rest of the solvent blend was varied, as shown in Table II below. The alcohol employed was industrial methylated spirit. The rest of the solvent blend was a mixture of sucrose, sorbitol and water in a ratio of sucrose: sorbitol: water of 2.5:1.0:2.5. The soap employed was a blend, with respect to the total composition, of 10 wt% tallow stearine (iodine value 18) and 20 wt% coconut oil derived soaps. The bars were made by the procedure set out under Examples 1 to 3 and their setting temperature was measured. The results are given in Table II.

TABLE II

| Example | 4 | 5 | 6 | 7 | 8 | 9 |
|---|---|---|---|---|---|---|
| Total soap | 30 | 30 | 30 | 30 | 30 | 30 (wt %) |
| Alcohol | 0 | 5 | 10 | 15 | 20 | 30 (wt %) |
| Rest of solvent blend | 70 | 65 | 60 | 55 | 50 | 40 (wt %) |
| Setting temp. | >50 | >50 | 48 | 46 | 45 | 38 (°C.) |

Example 4 having 0 wt% alcohol yielded a hexagonal liquid crystal phase in the melt leading to an opaque and soft bar on cooling. Example 9 containing 30 wt% alcohol had a setting temperature of 38° C. which meant that the bar would be soft and have a tendency to stickiness particularly in for example hot climates. Examples 5 to 8 embodying the present invention were translucent and had a setting temperature of at least 40° C. and had acceptable hardness and rate of wear properties.

EXAMPLES 10 to 15

A series of bars was prepared following the procedure given under Examples 1 to 3 in which the ratio of sucrose to the rest of the solvent blend was varied from 0 wt% to 40 wt% with respect to the total weight of the bar. The rest of the solvent blend comprised a mixture of alcohol (industrial methylated spirit), sorbitol and water in a ratio of alcohol to sorbitol to water of 1.0:1.0:2.5. The soap component was a blend of 10 wt% tallow stearine (iodine value 18) and 20 wt% coconut oil derived soaps, calculated with respect to the total bar weight.

The setting temperature for each bar and whether or not the bar was translucent are recorded in Table III below with the composition of each bar.

TABLE III

| Example | 10 | 11 | 12 | 13 | 14 | 15 | 16 | 17 | 18 | |
|---|---|---|---|---|---|---|---|---|---|---|
| Total soap | 30 | 30 | 30 | 30 | 30 | 30 | 30 | 30 | 30 | (wt %) |
| Sucrose | 0 | 5 | 10 | 15 | 20 | 25 | 30 | 35 | 40 | (wt %) |
| Rest of solvent blend | 70 | 65 | 60 | 55 | 50 | 45 | 40 | 35 | 30 | (wt %) |
| Setting temperature | 38 | >40 | >40 | >40 | >45 | >45 | >45 | >45 | >45 | (°C.) |
| Transparency | no | no | no | yes | yes | yes | yes | no | no | |

Examples 10 to 12 having 10 wt% or less sucrose were not deemed translucent. Examples 17 and 18 having 35 wt% or more sucrose yielded hexagonal liquid crystal in the melt producing opaque and soft bars on cooling. Only Examples 13 to 16 containing between 15 and 30 wt% sucrose yielded translucent bars having acceptable user properties.

EXAMPLES 19 to 25

A series of bars was produced following the procedure of Examples 1 to 3 in which the water content was varied between 10 and 40 wt% with respect to the total weight of the bar. The soap blend employed was a mixture of 10 wt% tallow stearine (iodine value 18) and 20 wt% coconut oil derived soaps, calculated with respect to the total weight of the bar. The rest of the solvent blend was a mixture of alcohol (industrial methylated spirit), sorbitol and sucrose in a ratio of alcohol to sorbitol to sucrose of 1.0:1.0:2.5. The compositions of the bars are given in Table IV below.

TABLE IV

| Example | 19 | 20 | 21 | 22 | 23 | 24 | 25 |
|---|---|---|---|---|---|---|---|
| Total soap | 30 | 30 | 30 | 30 | 30 | 30 | 30 (wt %) |
| Water | 10 | 15 | 20 | 25 | 30 | 35 | 40 (wt %) |
| Rest of solvent blend | 60 | 55 | 50 | 45 | 40 | 35 | 30 (wt %) |

Examples 24 and 25 containing 35 wt% and above amount of water had an unacceptably low degree of translucency. At a water level of 10 wt% (Example 19) the translucency was again unacceptably low. Examples 20 to 23 having a water content of 15 to 30 wt% had good translucency and acceptable user properties.

EXAMPLES 26 to 31

A series of bars was produced following the procedure under Examples 1 to 3 which contained an amount of sorbitol varying from 0 to 30 wt% with respect to the total weight of the bar. The soap blend was a mixture of 10 wt% tallow stearine (iodine value 18) and 20 wt% coconut oil derived soaps, calculated with respect to the total weight of the bar. The solvent blend was a mixture of alcohol (industrial methylated spirit), sucrose and water in a ratio of alcohol to sucrose to water of 1.0:2.5:2.5. The compositions of the Examples are given in Table V below.

TABLE V

| Example | 26 | 27 | 28 | 29 | 30 | 31 |
|---|---|---|---|---|---|---|
| Total soap | 30 | 30 | 30 | 30 | 30 | 30 (wt %) |
| Sorbitol | 0 | 5 | 10 | 15 | 20 | 30 (wt %) |
| Solvent blend | 70 | 65 | 60 | 55 | 50 | 40 (wt %) |

Examples 26 to 30 containing 0 to 20 wt% sorbitol yielded an isotropic melt producing translucent bars having acceptable user properties. Example 31 containing 30 wt% sorbital yielded a melt containing a hexagonal liquid crystal phase which on cooling produced bars which were unacceptably opaque and soft.

EXAMPLES 32 to 36

A series of bars was prepared following the procedure of Examples of 1 to 3 which contained a variety of polyols at a level of 10 wt% and, in the case of Example 36, 10 wt% propan-1,2,-diol. The soap blend employed was a mixture of 13 wt% tallow stearine (iodine value 18) and 17 wt% coconut oil derived soaps, calculated with respect to the total bar weight. The basic solvent blend was a mixture of alcohol (industrial methylated spirit), sucrose and water. The polyols employed in separate bars were sorbitol, glycerol, polyethyleneglycol having a molecular weight of 400 (PEG400) and digol. The composition of each bar, its setting temperature and whether or not it was deemed translucent are given in Table VI below.

TABLE VI

| Example | 32 | 33 | 34 | 35 | 36 |
|---|---|---|---|---|---|
| Tallow stearine soap | 13 | 13 | 13 | 13 | 13 (wt %) |
| Coconut oil soap | 17 | 17 | 17 | 17 | 17 (wt %) |
| Sucrose | 25 | 25 | 25 | 25 | 25 (wt %) |
| Alcohol | 10 | 10 | 10 | 10 | 10 (wt %) |
| Water | 25 | 25 | 25 | 25 | 25 (wt %) |
| Polyol (10 wt %) | Sorbitol | Glycerol | PEG400 | Digol | Propan-1,2-diol |
| Setting temperature | 49 | 49 | 52 | 53 | 47 (°C.) |
| Transparency | yes | yes | yes | yes | no |

Each of Examples 32 to 35 containing soap and solvent blend embodying the present invention and additionally 10 wt% of a polyol, as defined above, yielded a bar having an acceptable high setting temperature and good translucency. Example 36 containing both 10 wt% industrial methylated spirit and 10 wt% propan-1,2-diol leading to a total alcohol content of 20 wt% yielded a bar which tended to grow large crystals and hence reduced translucency.

In addition to Examples 32 to 35 acceptable bars in terms of translucency and user properties were produced in which the 10 wt% sorbitol content of Example 32 was partially replaced by one or more polyethyleneglycols having molecular weights between 600 and 6000.

EXAMPLES 37 to 43

A series of bars was prepared following the procedure in Examples 1 to 3 in which the ratio of insoluble to soluble soaps was varied. The solvent blend employed was a mixture of sucrose, sorbitol, alcohol (industrial methylated spirit) and water. The compositions of the bar and their respective setting temperatures are given in Table VII below. All of the bars were translucent.

TABLE VII

| Example | 37 | 38 | 39 | 40 | 41 | 42 | 43 |
|---|---|---|---|---|---|---|---|
| Palmitate soap | 15 | 10 | 6 | 5 | 4 | 2 | 0 (wt %) |
| Stearate soap | 15 | 10 | 6 | 5 | 4 | 2 | 0 (wt %) |
| Oleate soap | 0 | 0 | 3 | 3 | 2 | 1 | 0 (wt %) |
| Coconut soap | 0 | 10 | 15 | 17 | 20 | 25 | 30 (wt %) |
| Sucrose | 25 | 25 | 25 | 25 | 25 | 25 | 25 (wt %) |
| Sorbitol | 10 | 10 | 10 | 10 | 10 | 10 | 10 (wt %) |
| Alcohol | 10 | 10 | 10 | 10 | 10 | 10 | 10 (wt %) |
| Water | 25 | 25 | 25 | 25 | 25 | 25 | 25 (wt %) |
| Setting temperature | 58 | 53 | 50 | 49 | 48 | 38 | 35 (°C.) |

According to the definition set out above palmitate and stearate are deemed insoluble soaps and oleate and coconut oil derived soaps are deemed soluble soaps. Examples 42 and 43 containing 4 wt% or less of insoluble soaps yielded a bar having a setting temperature below 40° C. Examples 37 and 38 containing between 30 and 20 wt% insoluble soaps and 10 wt% or less of soluble soaps had inferior user properties due to the low level of soluble soaps.

Examples 39 to 41 containing between 12 to 8 wt% insoluble soaps and 18 to 26 wt% soluble soaps were subjected to a series of rate of wear, mush and lather tests to assess their in-use properties relative to a conventional opaque extruded toilet soap having a 86 wt% soap content derived from a blend comprising 82 wt% tallow soaps and 18 wt% coconut soaps.

The bars were tested for lather, both subjectively for creaminess and volume and objectively in terms of lather volume, rate of wear and mushiness of the bar surface in use. The subjective lather testing was performed by an experienced panel freely hand-wahing using the bars. Rate of wear and mushiness of the bar surface in use were assessed by washing down the bars at irregular intervals seven times daily over a four-day period and then examining and weighing the resulting bars. The mushing characteristics of the bars were additionally tested by immersing them in cold water for 2 hours and objectively measuring the resulting soft surface layer.

Each bar was assessed and given a relative score rating in each test. The results are given in Table VIII below. For the scores relating to lather the higher the score recorded, the better the lather property. For the scores relating to rate of wear and mush the lower the score recorded the better the observed property.

TABLE VIII

| | | Mush | | Lather | |
|---|---|---|---|---|---|
| Example | Rate of Wear (%) | Immersion | In-use | Objective | Subjective |
| Conventional toilet soap | 25 | 7.1 | 5.3 | 40 | 1.19 |
| 39 | 24 | 16.0 | 0.7 | 10 | 0.63 |
| 40 | 25 | 15.0 | 0.8 | 17 | 0.85 |
| 41 | 25 | 9.0 | 0.0 | 26 | 1.15 |

Each of the Examples 39 to 41 had a rate of wear equivalent to that of the comparative conventional toilet soap and had improved in-use mush properties. Examples 40 and 41 had in-use lather properties equivalent to that of conventional toilet soap whilst Example 39 had somewhat reduced lather properties relative to the comparative test bar.

EXAMPLES 44 to 51

A series of bars was prepared following the procedure in Examples 1 to 3 in which the ratio of palmitate soap to stearate soap was varied between 100:0 to 0:100. The total soap content comprised 30 wt% of the bar and included 22 wt% of soluble soaps. The solvent blend comprised 70 wt% of the bar and comprised a mixture of sucrose, sorbitol, alcohol (industrial methylated spirit) and water in a ratio of sucrose: sorbitol: alcohol: water of 2.5:1.0:1.0:2.5. The compositional details of the bars, their state of translucency and their setting temperature are given in Table IX below.

TABLE IX

| Example | 44 | 45 | 46 | 47 | 48 | 49 | 50 | 51 (wt %) |
|---|---|---|---|---|---|---|---|---|
| Palmitate soap | 8 | 7 | 6 | 5 | 4 | 3 | 2 | 0 (wt %) |
| Stearate soap | 0 | 1 | 2 | 3 | 4 | 5 | 6 | 8 (wt %) |
| Oleate soap | 2 | 2 | 2 | 2 | 2 | 2 | 2 | 2 (wt %) |
| Coconut oil soap | 20 | 20 | 20 | 20 | 20 | 20 | 20 | 20 (wt %) |

TABLE IX-continued

| Example | 44 | 45 | 46 | 47 | 48 | 49 | 50 | 51 | (wt %) |
|---|---|---|---|---|---|---|---|---|---|
| Solvent blend | 70 | 70 | 70 | 70 | 70 | 70 | 70 | 70 | (wt %) |
| Transluency | yes | yes | yes | yes | yes | yes | yes | yes | |
| Setting temperature | >40 | >40 | >40 | >40 | >45 | >45 | >45 | >45 | (°C.) |

All of the basis were solid and translucent and had a setting temperature in excess of 40° C.

EXAMPLES 52 to 60

A series of bars was prepared following the procedure in Example 1 to 3 in which the type of soap, the amount of sucrose, the type and amount of alcohol, and the type and amount of optional polyol were varied. The formulations prepared are given in Table X below.

TABLE X

| Example | 52 | 53 | 54 | 55 | 56 | 57 | 58 | 59 | 60 | |
|---|---|---|---|---|---|---|---|---|---|---|
| Tallow stearine soap (IV = 18) | 10 | 10 | 10 | 10 | 10 | 10 | — | — | — | (wt %) |
| Coconut soap | 20 | 20 | 20 | 20 | 20 | 20 | 30 | 20 | 15 | (wt %) |
| Tallow soap | — | — | — | — | — | — | — | 10 | 15 | (wt %) |
| Sucrose | 25 | 25 | 15 | 15 | 15 | 15 | 25 | 25 | 25 | (wt %) |
| PEG400 | — | — | 10 | — | — | 10 | — | — | — | (wt %) |
| Diethylene glycol | — | — | — | 10 | 10 | — | — | — | — | (wt %) |
| Sorbitol | 10 | 10 | 10 | 10 | 10 | 10 | 10 | 10 | 10 | (wt %) |
| Ethanol | 5 | 3 | 10 | 10 | 5 | 5 | — | — | — | (wt %) |
| Propan-1,2-diol | 5 | 7 | — | — | 5 | 5 | — | — | — | (wt %) |
| IMS | — | — | — | — | — | — | 10 | 10 | 10 | (wt %) |
| Water (distilled) | 24 | 24 | 24 | 24 | 24 | 24 | 24 | 24 | 24 | (wt %) |
| Perfume | 1 | 1 | 1 | 1 | 1 | 1 | 1 | 1 | 1 | (wt %) |

IMS is industrial methylated spirit. PEG 400 is polyethyleneglycol having an average molecular weight of 400.

Each bar was assessed as described above in respect of Examples 39 to 41 for user properties in terms of rate of wear, mush and lather. The results are given in Table XI below.

TABLE XI

| Example | Rate of wear (%) | Mush In-use | Mush Immersion | Lather (magnitude) |
|---|---|---|---|---|
| 52 | 26 | 0.7 | 9.5 | 1.13 |
| 53 | 26 | 0.2 | 9.7 | 1.02 |
| 54 | 26 | 0 | 9.5 | 1.01 |
| 55 | 24 | 0.3 | 9.4 | 1.08 |
| 56 | 27 | 0 | 11.0 | 1.07 |
| 57 | 23 | 0 | 9.6 | 0.94 |
| 58 | 58 | 35.0 | 16.0 | 1.23 |
| 59 | 30 | 21.0 | 14.0 | 1.14 |
| 60 | 27 | 11.0 | 12.0 | 1.12 |
| Control | 23 | 5.0 | 8.0 | 1.18 |

All of examples 52 to 57 which embody the present composition had acceptable user properties relative to the control which was a conventional opaque extruded toilet soap bar as described under Examples 39 to 41. Each of Examples 58 to 60 had either unacceptable high rate of wear and/or too high mush figures. The insoluble soap content of Examples 58 to 60 were respectively approximately 0 wt%, 5 wt% and 7.5 wt% with respect to the total weight of the bar i.e. less than the minimum presently required. In addition the setting temperature of each of Examples 58 to 60 was less than 40° C.

EXAMPLES 61 to 69

A series of bars was prepared according to the procedure described in Examples 1 to 3 in order to assess the effect of the soap level on translucency and hardness. The series employed a soap formulation comprising tallow stearine soap (iodine value 18): coconut oil soap at a ratio of 1:1. The tallow stearine soap (IV 18) consisted approximately of 40 wt% palmitate soap, 40 wt% stearate soap and 20 wt% oleate soap. The coconut soap consisted almost entirely of laurate soaps. A 1:1 blend of the two soaps thus, according to the above definition, provided a soap formulation containing insoluble soap and soluble soap in a ratio of insoluble soap to soluble soap of 2:3.

The total soap content for the bar series was varied between 20 and 40 wt% and the physical state of the bars at the melt stage (70° to 85° C.) and after setting at ambient temperature (20° C.) was assessed. The solvent blend comprising the remainder of the bar in each case was a mixture of sucrose, sorbitol, alcohol (industrial methylated spirit) and water in a ratio of 2.5:1.0:1.0:2.5. The results are given in Table XII below.

TABLE XII

| Example | Formulation Soap (wt %) | Formulation Melt | Set bars Tranlucency | Set bars Hardness |
|---|---|---|---|---|
| 61 | 20 | I | C | s |
| 62 | 25 | I | C | h |
| 63 | 30 | I | C | h |
| 64 | 31 | I | C | h |
| 65 | 32 | I | C | h |
| 66 | 33 | I | C | h |
| 67 | 34 | I | C | h |
| 68 | 35 | H/S | 0 | s |
| 69 | 40 | H/S | 0 | s |

I = Isotropic solution phase
H/S = Mixture of hexagonal liquid crystal and solution phases.
C = Clear solid
0 = Opaque solid
s = Soft solid
h = Hard solid Thus at total soap content of 35 wt% or more a non-isotropic melt was produced yielding a soft and opaque bar. The bar having a soap content of 20 wt% was clear and soft. Examples 62 to 67 having a soap content between 25 and 34 wt% yielded translucent hard bars.

We claim:

1. Translucent detergent bar containing with respect to the total weight of the bar 25 to 34 wt% soap, 5 to 15 wt% alcohol, 15 to 30 wt% sugar and/or cyclic polyol, and 15 to 30 wt% water, the soap comprising a soap mixture consisting of 18 to 26 wt% soluble soaps and 8 to 16 wt% insoluble soaps calculated with respect to the total weight of the bar.

2. Detergent bar according to claim 1 wherein the soluble soaps present comprise with respect to the total weight of the bar 16 to 20 wt% saturated soaps having a carbon chain length of from 8 to 14 and 2 to 6 wt% oleate and/or polyunsaturated soaps.

3. Detergent bar according to claim 2 wherein the insoluble soaps present comprise with respect to the total weight of the final bar 8 to 12 wt% palmitate and/or stearate soaps and 0 to 6 wt% of other saturated soaps having a chain length of 20 and 22 carbon atoms.

4. Detergent bar according to claim 1 wherein the alcohol present is selected from the group consisting of industrial methylated spirit, ethanol and propan-1,2-diol.

5. Detergent bar according to claim 1 wherein the cyclic, polyol present is selected from the group consisting of sucrose, fructose and glucose.

6. Detergent bar according to claim 1 including 0 to 20 wt% with respect to the final bar weight of glycerol and/or a linear or branched polyol compound having a carbon content of 4 or more and 2 or more alcohol groups.

7. Detergent bar according to claim 6 wherein the polyol compound having a carbon content of 4 or more and, 2 or more alcohol groups is selected from the group consisting of diethyleneglycol, triethyleneglycol, sorbitol, mannitol and polyethyleneglycols having molecular weights between 400 and 6000.

8. Detergent bar according to claim 1 having a setting temperature of at least 40° C.

9. A method of making a translucent detergent bar comprising forming a melt at a temperature of between 70 and 85° C. of a mixture comprising 25 to 34 wt% soap, 5 to 15 wt% alcohol, 15 to 30 wt% sugar and/or other cyclic polyol, and 15 to 30 wt% water and cooling the melt to 30° C. or less, the soap comprising a soap mixture consisting of 18 to 26 wt% soluble soaps and 8 to 16 wt% insoluble soaps calculated with respect to the total weight of the bar.

10. A method according to claim 9 wherein the melt is cast into a pack made at least substantially of a flexible film, the pack is airtightly sealed while the melt is still liquid or semi-liquid, the melt is allowed to set to a substantially solid state and the set melt is retained in the pack as an airtight storage means.

* * * * *